US005775654A

United States Patent [19]

Price

[11] Patent Number: 5,775,654

[45] Date of Patent: Jul. 7, 1998

[54] TELESCOPING CUP HOLDING SYSTEM

[76] Inventor: Betty J. Price, 1 Lamont La., Greenville, S.C. 29611

[21] Appl. No.: 679,989

[22] Filed: Jul. 15, 1996

[51] Int. Cl.[6] ..... A47B 96/06

[52] U.S. Cl. ..... 248/231.61; 248/103; 248/231.41

[58] Field of Search ..... 248/231.61, 231.41, 248/288.31, 188.5, 205.2, 103

[56] References Cited

U.S. PATENT DOCUMENTS

| | | | |
|---|---|---|---|
| 936,254 | 10/1909 | Parsons | 248/231.41 |
| 1,554,118 | 9/1925 | Moran | 248/103 |
| 1,688,148 | 10/1928 | Martin | 248/288.31 |
| 1,753,875 | 4/1930 | Baumann . | |
| 1,894,991 | 1/1933 | Hayes . | |
| 2,470,694 | 5/1949 | Foo . | |
| 2,663,764 | 12/1953 | Holmes . | |
| 2,711,872 | 6/1955 | Lampke . | |
| 2,994,501 | 8/1961 | Barnard | 248/231.61 |
| 3,103,375 | 9/1963 | McMullin | 248/188.5 |
| 3,112,910 | 12/1963 | Bal | 248/188.5 |
| 4,078,756 | 3/1978 | Cross | 248/288.31 |
| 4,735,388 | 4/1988 | Marks | 248/103 |
| 4,858,990 | 8/1989 | Combs-Rose et al. | 297/184 |
| 5,040,756 | 8/1991 | Via Cara | 248/103 |
| 5,083,732 | 1/1992 | Akamine | 248/104 |
| 5,671,900 | 9/1997 | Cutler | 248/451 |

*Primary Examiner*—Leslie A. Braun
*Assistant Examiner*—Kimberly T. Wood

[57] ABSTRACT

A new Telescoping Cup Holding System for facilitating consumption of a drink from a standard cup for disabled persons or infants which provides support of the standard cup in adjustable horizontal and vertical positions. The inventive device includes a securing member which engages a chair arm or bed, a vertical telescoping member secured to the securing member providing an adjustable vertical support, a horizontal telescoping member secured to the vertical telescoping member opposite of the securing member providing an adjustable horizontal support, and a cup capturing member secured to the horizontal telescoping member opposite of the vertical telescoping member which releasably captures a standard cup for positioning in the proper position in relation to the user.

1 Claim, 3 Drawing Sheets

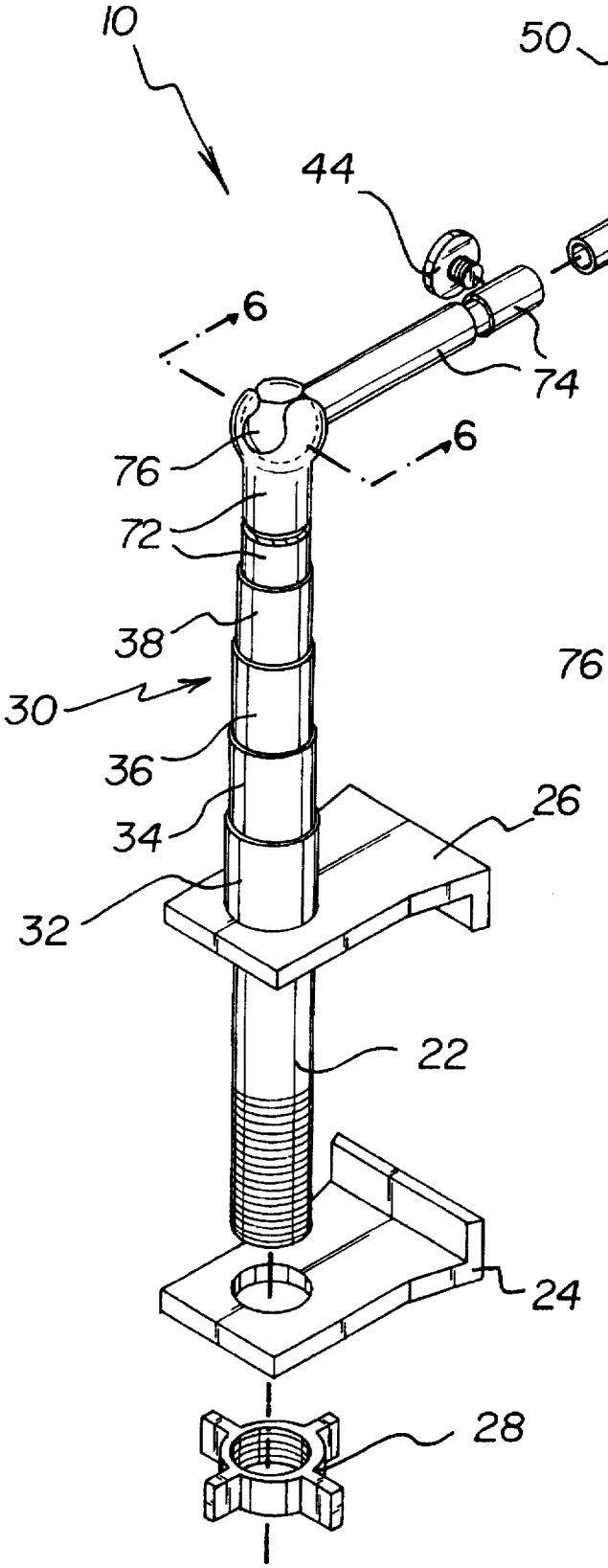
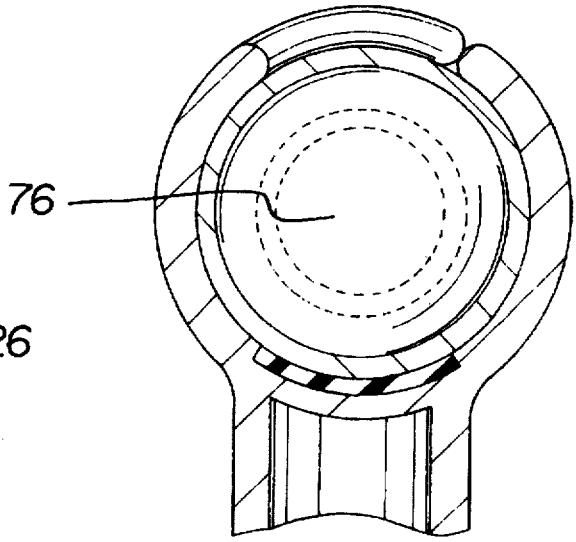
FIG.6
FIG.5

TELESCOPING CUP HOLDING SYSTEM

BACKGROUND OF THE INVENTION

1. Field of the Invention

The present invention relates to Holding Devices and more particularly pertains to a new Telescoping Cup Holding System for facilitating consumption of a drink from a standard cup for disabled persons or infants which provides support of the standard cup in adjustable horizontal and vertical positions.

2. Description of the Prior Art

The use of Holding Devices is known in the prior art. More specifically, Holding Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Holding Devices include U.S. Pat. No. 4,871,154; U.S. Pat. No. 5,232,262; U.S. Design Pat. No. 259,300; U.S. Pat. No. 4,559,735; U.S. Pat. No. 4,135,706 and U.S. Pat. No. 3,653,775.

While these devices fulfill their respective, particular objectives and requirements, the aforementioned patents do not disclose a new Telescoping Cup Holding System. The inventive device includes a securing means which engages a chair arm or bed, a vertical telescoping means secured to the securing means providing an adjustable vertical support, a horizontal telescoping means secured to the vertical telescoping means opposite of the securing means providing an adjustable horizontal support, and a cup capturing means secured to the horizontal telescoping means opposite of the vertical telescoping means which releasably captures a standard cup for positioning in the proper position in relation to the user.

In these respects, the Telescoping Cup Holding System according to the present invention substantially departs from the conventional concepts and designs of the prior art, and in so doing provides an apparatus primarily developed for the purpose of facilitating consumption of a drink from a standard cup for disabled persons or infants which provides support of the standard cup in adjustable horizontal and vertical positions.

SUMMARY OF THE INVENTION

In view of the foregoing disadvantages inherent in the known types of Holding Devices now present in the prior art, the present invention provides a new Telescoping Cup Holding System construction wherein the same can be utilized for facilitating consumption of a drink from a standard cup for disabled persons or infants which provides support of the standard cup in adjustable horizontal and vertical positions.

The general purpose of the present invention, which will be described subsequently in greater detail, is to provide a new Telescoping Cup Holding System apparatus and method which has many of the advantages of the Holding Devices mentioned heretofore and many novel features that result in a new Telescoping Cup Holding System which is not anticipated, rendered obvious, suggested, or even implied by any of the prior art Holding Devices, either alone or in any combination thereof.

To attain this, the present invention generally comprises a securing means which engages a chair arm or bed, a vertical telescoping means secured to the securing means providing an adjustable vertical support, a horizontal telescoping means secured to the vertical telescoping means opposite of the securing means providing an adjustable horizontal support, and a cup capturing means secured to the horizontal telescoping means opposite of the vertical telescoping means which releasably captures a standard cup for positioning in the proper position in relation to the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Telescoping Cup Holding System apparatus and method which has many of the advantages of the Holding Devices mentioned heretofore and many novel features that result in a new Telescoping Cup Holding System which is not anticipated, rendered obvious, suggested, or even implied by any of the prior art Holding Devices, either alone or in any combination thereof.

It is another object of the present invention to provide a new Telescoping Cup Holding System which may be easily and efficiently manufactured and marketed.

It is a further object of the present invention to provide a new Telescoping Cup Holding System which is of a durable and reliable construction.

An even further object of the present invention is to provide a new Telescoping Cup Holding System which is susceptible of a low cost of manufacture with regard to both materials and labor, and which accordingly is then susceptible of low prices of sale to the consuming public, thereby making such Telescoping Cup Holding System economically available to the buying public.

Still yet another object of the present invention is to provide a new Telescoping Cup Holding System which provides in the apparatuses and methods of the prior art some of the advantages thereof, while simultaneously overcoming some of the disadvantages normally associated therewith.

Still another object of the present invention is to provide a new Telescoping Cup Holding System for facilitating consumption of a drink from a standard cup for disabled persons or infants which provides support of the standard cup in adjustable horizontal and vertical positions.

Yet another object of the present invention is to provide a new Telescoping Cup Holding System which includes a securing means which engages a chair arm or bed, a vertical telescoping means secured to the securing means providing an adjustable vertical support, a horizontal telescoping means secured to the vertical telescoping means opposite of the securing means providing an adjustable horizontal support, and a cup capturing means secured to the horizontal telescoping means opposite of the vertical telescoping means which releasably captures a standard cup for positioning in the proper position in relation to the user.

Still yet another object of the present invention is to provide a new Telescoping Cup Holding System that clamps to an existing chair or bed providing support of a standard cup.

Even still another object of the present invention is to provide a new Telescoping Cup Holding System that is useful for disabled persons and infants providing support of the standard cup while preventing falls or spills.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded isometric view of the present invention disclosing the relationship of the threaded clamping knob with the threaded shaft.

FIG. 6 is a cross sectional view taken along line 6—6 of FIG. 5 disclosing the ball in socket joint.

DESCRIPTION OF THE PREFERRED EMBODIMENT

Figure 2:
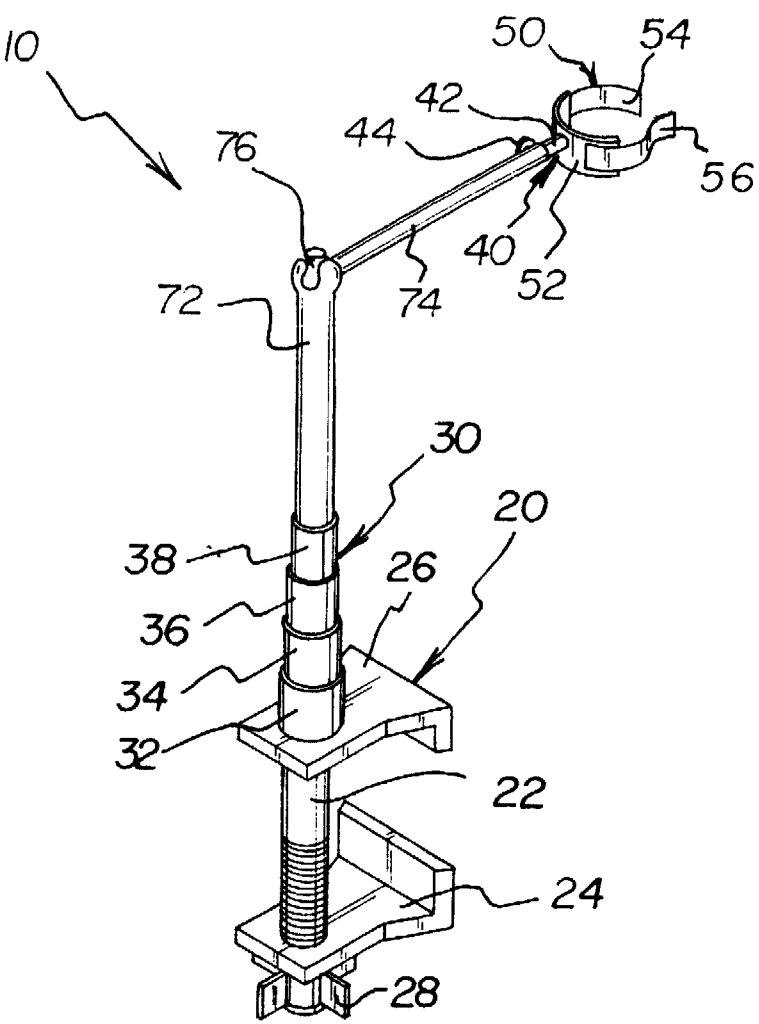
FIG. 2 is a side perspective view of the present invention disclosing the cup capturing means in the open position.
Figure 1:
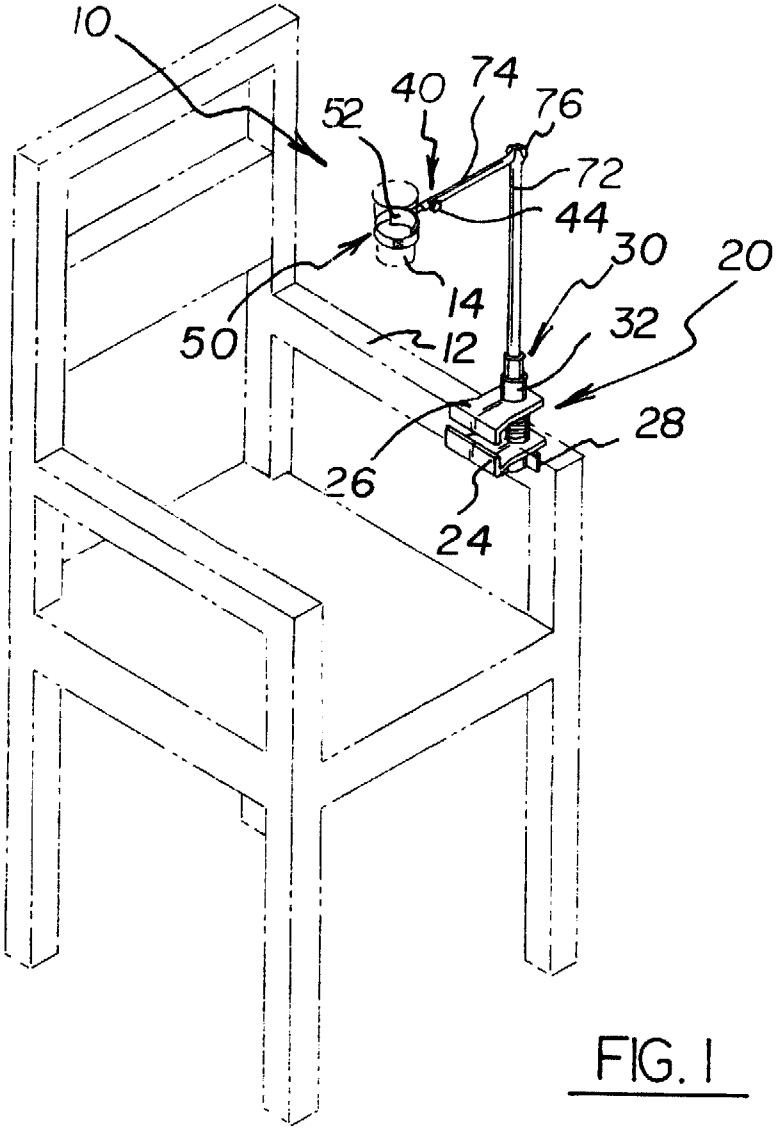
FIG. 1 a side perspective view of a new Telescoping Cup Holding System secured to a chair arm and retaining a standard cup according to the present invention.
Figure 4:
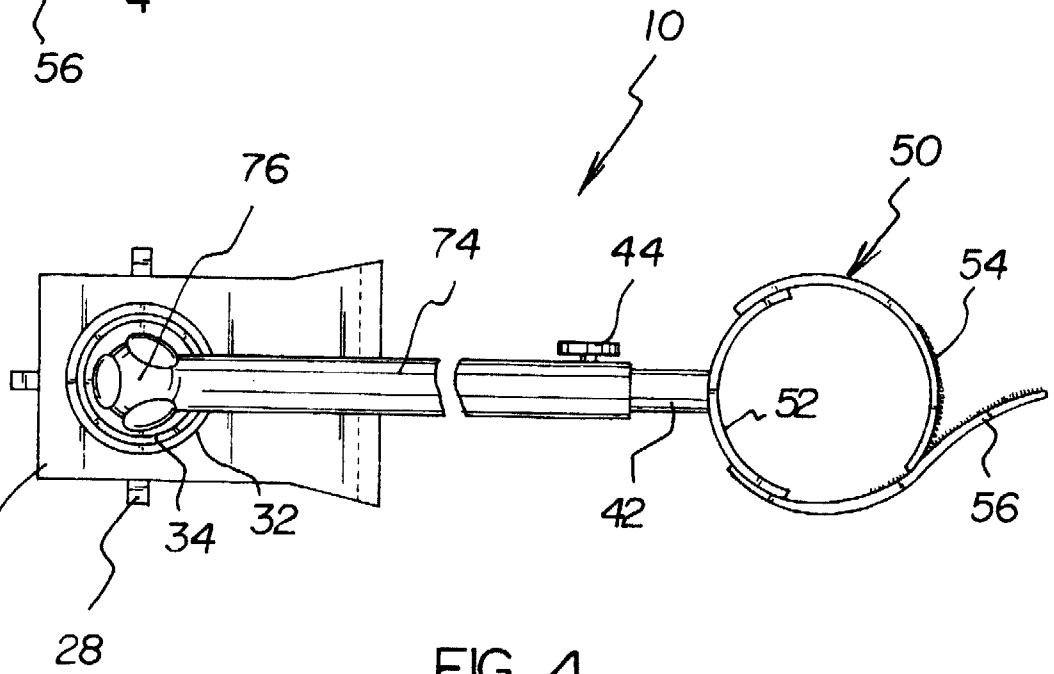
FIG. 4 is a top view of the invention showing the cup capturing means in the closed position.
Figure 3:
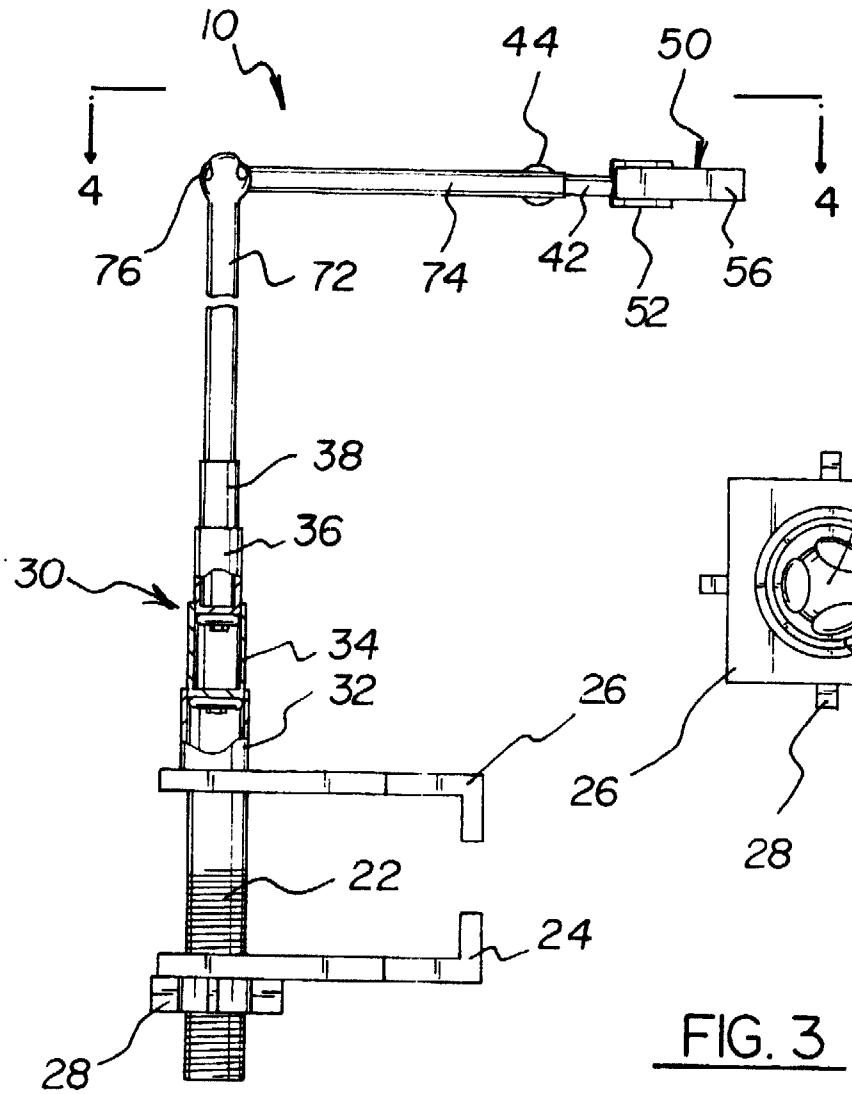
FIG. 3 is a side view of the present invention disclosing the securing means.

With reference now to the drawings, and in particular to FIGS. 1 through 6 thereof, a new Telescoping Cup Holding System embodying the principles and concepts of the present invention and generally designated by the reference numeral 10 will be described.

More specifically, it will be noted that the Telescoping Cup Holding System 10 comprises a securing means 20 which engages a chair or bed, a vertical telescoping means 30 secured to the securing means 20 projecting vertically upward, a horizontal telescoping means 40 secured to the vertical telescoping means 30 opposite of the securing means 20, and a cup capturing means 50 secured to the end of the horizontal telescoping means 40 opposite of the vertical telescoping means 30.

As best illustrated in FIGS. 1 through 5, it can be shown that the securing means 20 includes a threaded shaft 22. A top clamping member 26 is secured to the upper portion of the threaded shaft 22 projecting orthogonally to said threaded shaft 22. A bottom clamping member 24 is slidably attached to the threaded shaft 22 below the top clamping member 26. A threaded clamping knob 28 rotatably engages the bottom portion of the threaded shaft 22 juxtaposed to the bottom surface of the bottom clamping member 24 providing the force necessary for the top and bottom clamping members 24 to capture an object mesial. The vertical telescoping means 30 includes a base tube 32 secured to the top surface of said top clamping member 26 projecting along the longitudinal axis of the threaded shaft 22 as best disclosed in FIG. 3 of the drawings. A first projecting tube 34 is slidably positioned within the base tube 32. A second projecting tube 36 is slidably positioned within the first projecting tube 34. A third projecting tube 38 is slidably positioned within the second projecting tube 36. A vertical rod 72 is slidably positioned within the third projecting tube 38. A ball in socket joint 76 is secured to the end of the vertical rod 72 opposite of the third projecting tube 38. A horizontal tube 74 is secured to the ball in socket joint 76 opposite of the vertical rod 72. A horizontal telescoping means 40 includes an extending rod 42 slidably positioned within the horizontal tube 74 in the end opposite of the ball in socket joint 76. An adjusting member 44 projects through the horizontal tube 74 near the end closed to the extending rod 42, thereby engaging the extending rod 42 preventing movement. The cup capturing means 50 includes a semi-circular support band 52 with the central portion secured to the end of the extending rod 42 opposite of the horizontal tube 74 and formed to shape of a standard cup 14. A hook fastening strap 54 is secured to one end of the semi-circular support band 52. A loop fastening strap 56 is secured to the end of the semi-circular support band 52 opposite of the hook fastening strap 54. The loop fastening strap 56 removably engages the hook fastening strap 54 thereby capturing the standard cup 14.

In use, the user positions a chair arm 12 or an unnumbered portion of a bed mesial the top and bottom clamping members 24 and 26. The user then tightens the threaded clamping knob 28 compressing said clamping members 24 and 26 around the chair arm 12 or the unnumbered portion of a bed. The standard cup 14 is positioned against the interior wall of the semi-circular support band 52. The loop fastening strap 56 is thereafter wrapped around the standard cup 14 to engage the hook fastening strap 54 thereby retaining the standard cup 14 within the present invention. The user may then adjust the vertical telescoping means 30 by manually manipulating the position of the tubes 34, 36, and 38 in relation to one another. The horizontal positioning of the standard cup 14 is facilitated by extending or retracting the extending rod 42 slidably positioned within the horizontal tube 74. The user may then drink from the standard cup 14 leaving their hands free to manipulate other activities.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A telescoping cup holding system comprising:

a securing means for engaging an article of furniture;

a first telescoping member having first and second ends with said first end thereof being mounted on the securing means;

a second telescoping member having first and second ends with the first end thereof being coupled to the second end of said first telescoping member; and a cup capturing means secured to the second end of the second telescoping member for mounting a cup to said second telescoping member;

wherein the coupling of the first and second telescoping members comprises a ball mounted on an end of one said telescoping member and a socket mounted on an end of the other said telescoping member, said ball being positioned in said socket to permit pivoting of said second telescoping member with respect to said first telescoping member;

wherein the securing means includes:

a threaded shaft;

a top clamping member secured to the upper portion of the threaded shaft and projecting orthogonally with respect to said threaded shaft;

a bottom clamping member slidably attached to the threaded shaft below the top clamping member; and a clamping knob rotatably threadedly engaging the bottom portion of the threaded shaft adjacent to the bottom clamping member for forcing the bottom clamping member toward the top clamping member to capture a portion of an article of furniture positioned between the top and bottom clamping members;

wherein the first telescoping member includes:

a base tube secured to the securing means;

a first projecting tube slidably positioned within the base tube;

a second projecting tube slidably positioned within the first projecting tube;

a third projecting tube slidably positioned within the second projecting tube; and a rod slidably positioned within the third projecting tube;

wherein the second telescoping member includes:

a support tube coupled to the first telescoping member;

an extending rod slidably positioned within support tube; and an adjusting member projecting through the support tube near the end adjacent to the extending rod to engage the extending rod to prevent movement of said rod relative to said support tube;

wherein the cup capturing means includes:

a semi-circular support band having a central portion secured to the second end of the second telescoping member;

a first fastening strap secured to one end of the semicircular support band; and a second fastening strap secured to the end of the semicircular support band opposite of the first fastening strap, said first and second fastening straps having hook and loop fastening means thereon for removably fastening the straps together about a cup positioned adjacent to the support band;

wherein the first telescoping member is fixedly secured to said securing means to prevent movement of said first telescoping member relative to said securing means;

wherein the first and second telescoping members define a pivot angle therebetween, and wherein said socket is adapted to permit movement of said second telescoping member at pivot angles greater than about ninety degrees and prevent movement of said second telescoping member at a pivot angle less than about ninety degrees; and wherein the second telescoping member is rotatably secured to said cup capturing means to permit rotational movement of said cup capturing means relative to said second telescoping member.

* * * * *